United States Patent [19]

Sohrt

[11] Patent Number: 4,510,395

[45] Date of Patent: Apr. 9, 1985

[54] DOUBLE-AXLE DRIVE FOR ELECTRIC SELF-PROPELLED RAILWAY VEHICLE

[75] Inventor: Christian Sohrt, Berlin, Fed. Rep. of Germany

[73] Assignee: Siemens Aktiengesellschaft, Berlin and Munich, Fed. Rep. of Germany

[21] Appl. No.: 429,866

[22] Filed: Sep. 30, 1982

[30] Foreign Application Priority Data

Oct. 8, 1981 [DE] Fed. Rep. of Germany ..... 3140167

[51] Int. Cl.[3] ..... B61C 17/00

[52] U.S. Cl. ..... 290/3; 105/136; 105/137; 310/255

[58] Field of Search ..... 290/3; 310/255; 105/136, 137

[56] References Cited

U.S. PATENT DOCUMENTS 4,130,065 12/1978 Susdorf et al. ..... 310/255

4,461,218 7/1984 Kuhlow et al. ..... 105/137

FOREIGN PATENT DOCUMENTS 2606807 5/1980 Fed. Rep. of Germany .

*Primary Examiner*—William M. Shoop

*Assistant Examiner*—Shelley Wade

*Attorney, Agent, or Firm*—Kenyon & Kenyon

[57] ABSTRACT

A longitudinal double-axle drive for an electric, track-bound, self-propelled vehicle is disclosed in which the electric propulsion motor is disposed longitudinally between two driving axles of the vehicle. The motor drives both driving axles via a respective angle transmission. In order to provide flexiblity for operating under different conditions, the electric propulsion motor is a double motor with two electrically independent rotors of equal length and a common stator comprised of two separate stator lamination stacks and a continuous stator winding. The side of each rotor facing its associated transmission is supported by an overhung arrangement from the transmission housing. Thereby, the two driving axles can rotate at different speeds without compulsion forces being generated.

4 Claims, 4 Drawing Figures

DOUBLE-AXLE DRIVE FOR ELECTRIC SELF-PROPELLED RAILWAY VEHICLE

BACKGROUND OF THE INVENTION

The present invention relates to a double-axle drive for a track-bound, electric self-propelled vehicle in which the electric propulsion motor is arranged longitudinally between two driving axles of the vehicle.

U.S. Pat. No. 4,130,065 discloses a double-axle drive longitudinally arranged between two driving axles in which the otherwise customary end bells of the electric propulsion motor are eliminated since the rotor shaft is supported in the pinion bearings of an angle or miter transmission and therefore in the transmission housing. This results in considerable weight savings. In order to compensate for displacements of the rotor in the longitudinal drive, a centering coupling is disclosed in U.S. Pat. No. 4,130,065 which permits at least some longitudinal displacement in the vehicle of the rotor shaft. Additional weight reductions can be achieved by providing the propulsion motor without a housing.

DE-AS No. 26 06 807 discloses the desirability of providing the dual output electric propulsion motor as a double motor to introduce flexibility to meet different operating conditions which sometimes include different speeds of the two driving axles. The double motor disclosed in DE-AS No. 26 06 807 comprises two electrically independent rotors of equal length and a common stator comprised of two separate stator lamination stacks of equal length and a continuous stator winding. In such a double motor, the two rotors are subjected to a common, electrically undivided excitation, and a clean separation of the fluxes of both rotors is obtained. Thereby, unambiguous magnetic decoupling is provided. The equal length rotors have the same speed/torque characteristic and can rotate at different speeds so that compulsion forces caused by slippage phenomena due to differences in wheel diameters or when negotiating curves are not generated. The rotors are supported by a central shaft surrounded by an independent hollow shaft, where the central shaft mechanically couples the rotors to each other.

OBJECTS AND SUMMARY OF THE INVENTION

It is an object of the present invention to provide a longitudinal double-axle drive having the flexibility to operate under different conditions. It is a further object to provide such a drive with a low-weight, mechanically simplified electric propulsion motor.

The above and other objects are achieved by a longitudinal double-axle drive according to the invention including a double motor with two electrically independent rotors one side of each of which is supported by an overhung arrangement from the transmission housing of the drive. The side of each rotor supported by the overhung arrangement faces the associated transmission. The overhung arrangement can comprise an extension or projection of the transmission housing extending adjacent the rotor shaft and bearings disposed in a space between the extension of the transmission housing and the rotor shaft. Due to the independent overhung support of the two rotors, mechanical coupling between the two rotors is eliminated. Thereby, longitudinal displacements can be accommodated without the need for a separate coupling for the rotors. The centrifugal forces of the rotors and the forces of the transmission gears are taken up by the bearings and the transmission housing.

According to an aspect of the invention, the rotor and the shaft of the transmission gear to which it is coupled are supplied as a composite unit and can be installed readily during assembly as a unit into the stator.

According to another aspect of the invention, the rotor includes a recess and the bearings are drawn at least partially into the recess in the rotor.

A rotor supported overhung as described above is advantageously provided as a solid rotor or a disc rotor for vibration and stability considerations.

The above and other objects, features, aspects and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which.

DESCRIPTION OF THE PREFERRED EMBODIMENT

Figure 1:
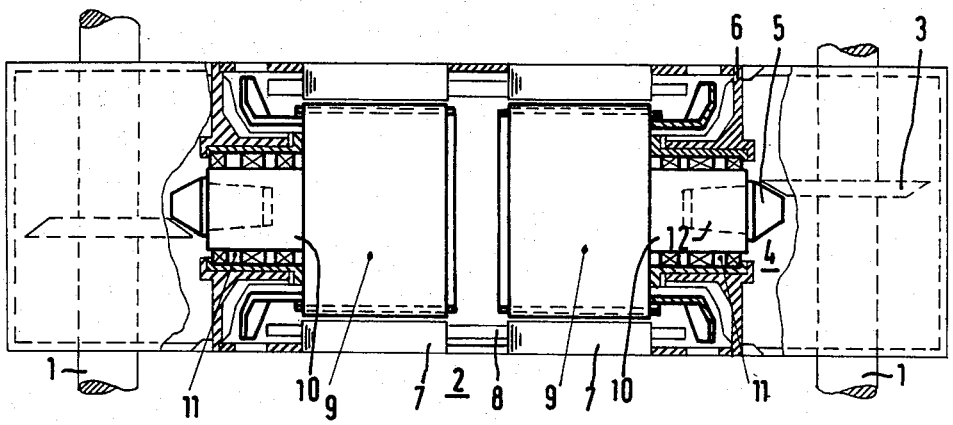
FIG. 1 is a schematic section view of a longitudinal double-axle drive according to the invention.

In the portion of the track-bound, self-propelled vehicle for local traffic shown in FIG. 1, two driving axles 1 are driven by an electric propulsion motor 2 which is disposed between the two axles in the longitudinal direction, i.e., the direction of motion, of the self-propelled vehicle. The motor 2 is a double motor. Each driving axle 1 is coupled by an elastic coupling (not shown) to a large gear 3 of an angle or miter gear transmission with which the pinion gear 5 of the electric propulsion motor 2 meshes. The housing 6 of the angle transmission 4 is supported on a hollow shaft (not shown) surrounding the driving axle 1.

The double motor, electric propulsion motor 2 has a common stator comprised of two separate stator lamination stacks 7 of equal length in the slots of which a continuous stator winding 8 is disposed. Similarly, the electric propulsion motor 2 has two identical rotors 9 of equal length. The end of each rotor facing its associated transmission is supported in the housing 6 of the angle transmission 4 by means of an extension or projection of the housing extending adjacent the rotor shaft and anti-friction bearings 11 disposed in the annular space between the housing extension and the rotor shaft. A respective pinion gear 5 is secured to a rotor 9 by inserting it into a shaped recess 12 in the end of the rotor shaft 10.

A double motor, electric propulsion motor 2 with a common stator winding 8 has the advantage that the two drive axles 1 can rotate at slightly different speeds without causing compulsion forces to be generated between the two independent rotors 9.

Figure 2:
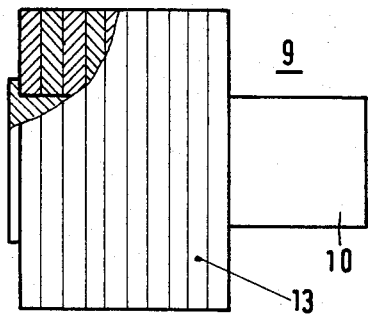
FIG. 2 is a side elevation view partly in section of a disc rotor according to an embodiment of the invention for the drive of FIG. 1.

Referring to FIG. 2, the rotor 9 of the electric propulsion motor is comprised of discs 13 which are clamped together. The discs 13 are shrunk onto the rotor shaft 10.

Figure 3:
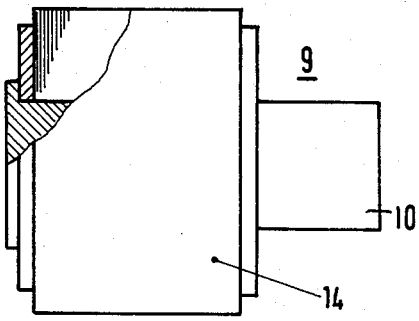
FIG. 3 is a side elevation view partly in section of another embodiment of a rotor according to the invention.

Referring to FIG. 3, the lamination stack 14 is conventionally disposed on the rotor shaft 10 of the rotor 9 with the rotor winding accommodated in the stack.

Figure 4:
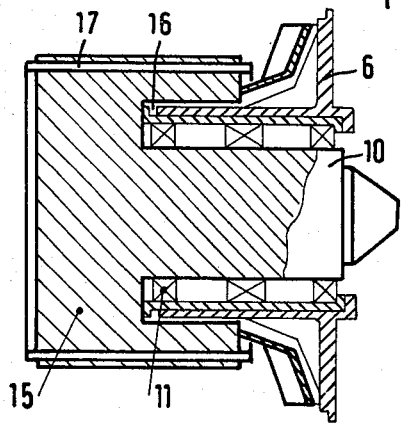
FIG. 4 is an axial section view of a solid rotor according to another embodiment of the invention.

Referring to FIG. 4, the rotor 9 is solid comprising a rotor body 15 made in one piece with the rotor shaft 10. To distribute bearing forces, the rotor body 15 is provided with a recess 16 on one side, in which the antifriction bearings 11 are at least partially disposed. The extension of the housing 6 of the angle transmission also extends at least partially into the recess 16. The rotor winding 17 can be a cage winding.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. In a longitudinal double-axle drive for an electric, track-bound, self-propelled vehicle which includes an electric propulsion motor longitudinally disposed between two drive axles of the vehicle, an angle transmission for each axle including a large gear elastically coupled to each axle and a pinion gear connected to the rotor shaft of the electric propulsion motor and meshing with the large gear, and a transmission housing for each angle transmission, the improvement comprising the electric propulsion motor being a double motor with two electrically independent rotors of equal length and a common stator comprised of two separate stator lamination stacks of correspondingly equal length and a continuous stator winding, and support means including a pair of overhung arrangements for separately and completely supporting each rotor, on a side thereof facing its associated transmission, from the respective transmission housing, each pinion gear being rigidly attached to a respective one of said two electrically independent rotors.

2. The apparatus according to claim 1 wherein the rotor shaft of the motor comprises two separate rotor shaft sections each connected to a respective one of said electrically independent rotors and wherein each of said overhung arrangements comprises an extension of the respective transmission housing which extends adjacent to the respective rotor shaft section and bearings disposed between the extension and the respective rotor shaft section.

3. The apparatus according to claim 1 wherein the rotors of the double motor are solid.

4. The apparatus according to claim 2, or 3 wherein each rotor includes a recess and said bearings are disposed at least partially in the recess.

* * * * *